United States Patent [19]

Dennis

[11] Patent Number: 4,727,945

[45] Date of Patent: Mar. 1, 1988

[54] CUTTING ELEMENT HAVING DIAMOND CUTTING BLANK REINFORCED BY A SHOULDER

[75] Inventor: Mahlon D. Dennis, Kingwood, Tex.

[73] Assignee: Strata Bit Corporation, Houston, Tex.

[21] Appl. No.: 947,175

[22] Filed: Dec. 29, 1986

[51] Int. Cl.[4] ..... E21B 10/46

[52] U.S. Cl. ..... 175/329; 175/410

[58] Field of Search ..... 175/329, 330, 410

[56] References Cited

U.S. PATENT DOCUMENTS

| | | | |
|---|---|---|---|
| 4,156,329 | 5/1979 | Daniels et al. | 175/329 X |
| 4,373,410 | 2/1983 | Davis | 175/329 X |
| 4,520,881 | 6/1985 | Phaal | 175/329 |
| 4,632,196 | 12/1986 | Dennis | 175/329 |

*Primary Examiner*—James A. Leppink
*Assistant Examiner*—Hoang C. Dang
*Attorney, Agent, or Firm*—Burns, Doane, Swecker & Mathis

[57] ABSTRACT

A cutting element includes a stud having an inclined supporting surface. The supporting surface intersects a side surface of the stud to form an edge. A cutting member is bonded to the supporting surface. A reinforcing shoulder projects from the supporting surface adjacent a rear portion of the cutting member. The shoulder includes a side surface, a portion of which intersects the edge along a region of the edge whose forwardmost point is spaced rearwardly from a rearwardmost point of the cutting member. When the cutting element is positioned within a bore of a drill bit, that region of the edge is completely positioned within the bore so as to be reinforced by the bore wall.

9 Claims, 6 Drawing Figures

CUTTING ELEMENT HAVING DIAMOND CUTTING BLANK REINFORCED BY A SHOULDER

BACKGROUND AND OBJECTS OF THE INVENTION

The present invention relates to the fabrication of cutting elements, particularly of the type in which a diamond covered compact is adhered to a stud.

One type of cutting element used in rotary drilling operations in earth formations is depicted in FIG. 1. That cutting element 8 comprises an abrasive composite or compact 10 mounted on a stud 12. The composite typically comprises a diamond layer 14 adhered to a cemented carbide substrate 16, e.g., tungsten carbide cemented by a metal binder such as cobalt. The substrate is brazed to the stud 12, and the stud is mounted in a drill bit by being fitted into predrilled holes in the drill bit.

During use of such a drill bit, it is not uncommon for the cutting elements to shear-off. In that regard, attention is directed to FIG. 1 herein in which is depicted the existence of fracture-susceptible zone 18 resulting from the geometry of the cutting element. That zone 18 is defined by a sharp corner formed by the intersection of the front surface 20 of the stud and the side surface 22 of the substrate 16. Thus, under the stresses induced during a cutting operation, a fracture line 24 can propogate rearwardly from the region 18, resulting in a shearing-off of the cutting portion of the cutting element.

One proposal for dealing with that problem involves the placement of a shroud 30 in supportive relationship to the compact 10 as depicted in FIGS. 2 and 3 and disclosed in greater detail in U.S. Pat. No. 4,632,196 issued Dec. 30, 1986 by the present inventor. That shroud includes an outer surface 31 which extends to, and is flush with, the peripheral surface 32 of the stud. The shroud bears against a peripheral edge portion of the compact for about 180 degrees to resist the cutting forces F which are applied to the compact during a cutting operation. In theory, it was hoped that the potential fracture point would be moved to the level 34 where the surface 20 intersects the peripheral surface 32 of the stud. Since the stud would be embedded sufficiently far into the bore in the drill bit, the drill bit would be reinforced around its periphery at that elevation 34 by the wall of the bore in which the stud is embedded. Therefore, the occurrence of fracturing would be resisted. In practice, however, there has occurred a tendency for fractures to form at higher elevations along the line of intersection of the surfaces 20 and 32, e.g., at elevation 36 in FIG. 2, as the cutting forces are transmitted to that region by the shroud 30. At that elevation, the stud is not reinforced by the bore wall, so fractures may occur.

It is, therefore, an object of the present invention to support a composite in such a manner that fractures do not tend to occur outside of a region of the stud which is to be reinforced by the bore wall.

SUMMARY OF A PREFERRED EMBODIMENT OF THE INVENTION

This object is achieved by the present invention which relates to a cutting element which is positionable within a drill bit body. The cutting element comprises a stud having a cylindrical side surface and an inclined supporting surface disposed at a forward end of the stud. The supporting surface is oriented at an acute angle relative to a longitudinal axis of the stud and intersects the side surface to form an edge. A cutting member is bonded to the supporting surface and comprises a substrate having thereon a cutting surface of polycrystalline diamond. The cutting member includes a peripheral surface. A reinforcing shoulder projects from the supporting surface adjacent a rear portion of the peripheral surface of the cutting member. The shoulder includes a contact face engaging the rear portion of the cutting member. The shoulder also includes a side surface which intersects the edge along a region of the edge whose forwardmost point is spaced rearwardly from a rearwardmost point of the cutting member. Such portion is substantially cylindrical and contiguous with the side surface of the stud so as to define a continuation thereof. When the cutting element is positioned within a bore of a drill bit, the forwardmost point of the intersected region of the edge is positioned within the bore so as to be reinforced by the bore wall.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 4:
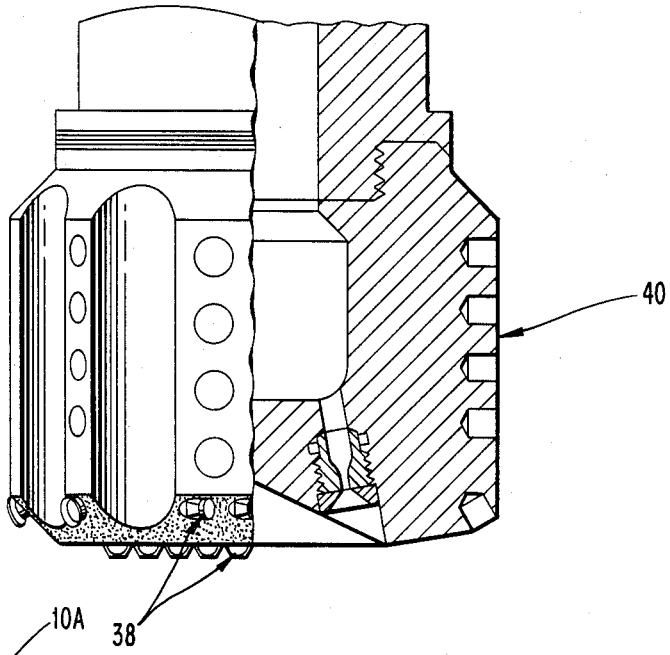
FIG. 4 is a side elevational view, with a portion broken away, of a drill bit containing cutting elements.
Figure 5:
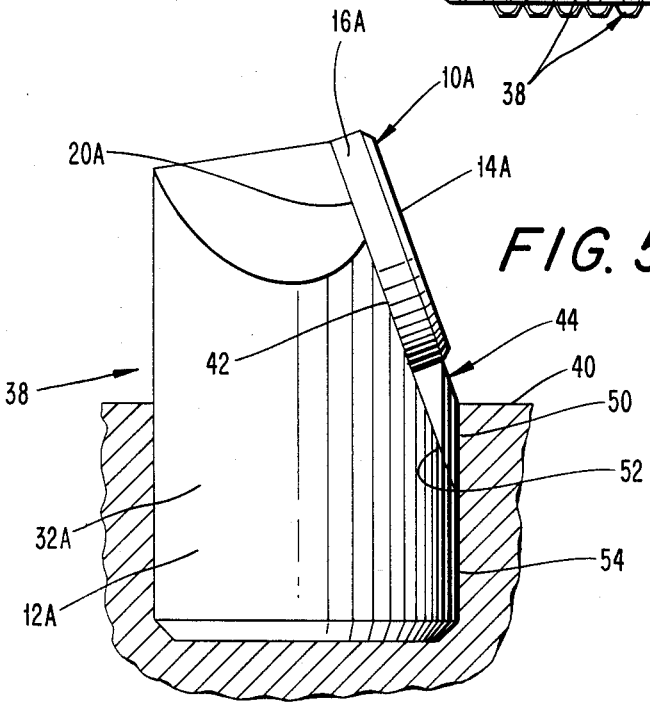
FIG. 5 is a side elevational view of a cutting element according to the present invention.
Figure 6:
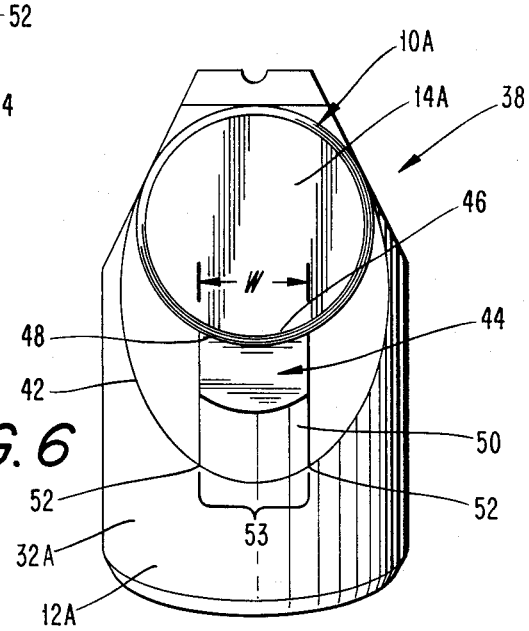
FIG. 6 is a front elevational view of the cutting element of FIG. 5 as viewed in a direction perpendicular to a supporting surface 20.

Depicted in FIG. 4 is a drill bit 40 in which cutting elements 38 according to the present invention are mounted in conventional fashion, e.g., by brazing or press-fit.

The cutting element comprises a conventional stud 12A formed of a hard material such as cemented tungsten carbide. The stud has an inclined supporting surface 20A to which a conventional circular cylindrical cutting disc 10A is mounted. The cutting disc 10A comprises a substrate 16A formed of a hard material such as cemented tungsten carbide, the underside of which is brazed to the supporting surface 20A of the stud in a conventional manner.

Mounted to the top surface of the substrate 16A is a layer of a diamond substance 14A. The diamond substance is preferably in the form of a thermally stable or unstable polycrystalline type which is sintered or brazed to the substrate by well known techniques. As a mater of interest, attention is directed to U.S. Pat. No. 3,745,623 for a discussion of methods for adhering a diamond layer to a carbide substrate, the disclosure of which is incorporated herein by reference.

The cutting disc 10A is located at a forward end of the stud 12A, with the rear end of the stud being mounted in the drill bit 40. The supporting surface 20A intersects a cylindrical outer surface 32A of the stud 12A to form an edge 42. The cutting disc 10A is located at a forward end of the supporting surface 20A. Projecting from the surface 20A behind the cutting disc is a shoulder 44 which supports the cutting disc against cutting forces applied during a cutting operation.

The shoulder 44 may comprise a separate member which is bonded to the surface 20A, or the shoulder may be formed as an integral part of the stud. A forward portion of the shoulder forms an arc-shaped contact face 46 which bears against a rear portion of a peripheral surface 48 of the substrate 16A of the cutting disc 10A. A side surface 50 of the shoulder extends from the ends of the contact face 46 to the edge 42 and intersects that edge 42 along a region 53 whose forwardmost point 52 is spaced rearwardly from a rearwardmost point of the outer periphery of the cutting disc and is also spaced rearwardly from the contact face 46.

The side surface 50 of the shoulder is of cylindrical configuration along the region 53 and is contiguous with the cylindrical surface 32A of the stud 12A. As a result, the stud can be placed within a bore 54 of the drill bit to such a depth that the forwardmost point 52 of the region 53 engages a portion of the bore wall.

The contact face 46 engages the surface 48 of the substrate along a distance W which is at least 50% of the longest dimension (e.g., diameter) of the substrate, and most preferably at least 67% thereof.

Figure 1:
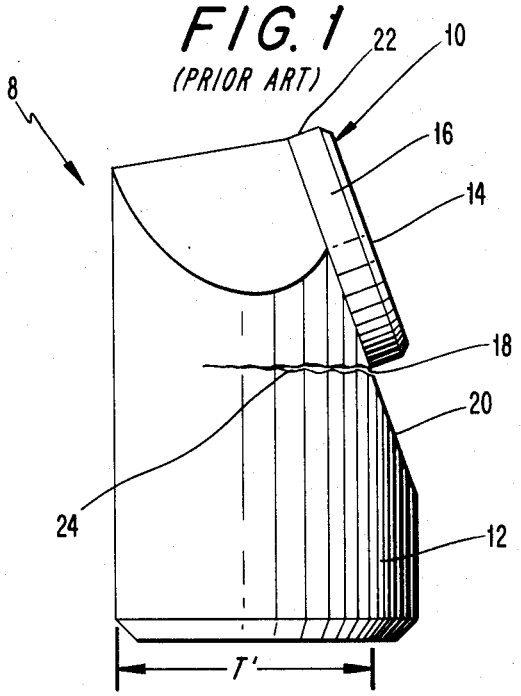
FIG. 1 (PRIOR ART)
FIG. 1 is a side elevational view of a conventional cutting element.
Figure 2:
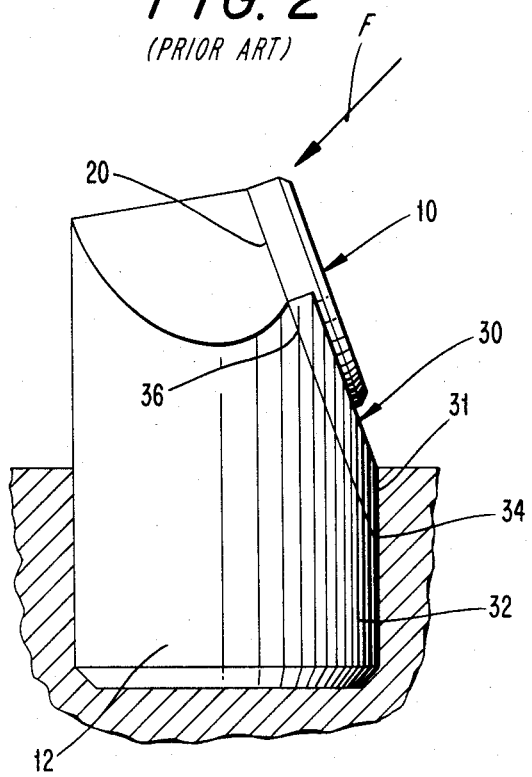
FIG. 2 (PRIOR ART)
FIG. 2 is a side elevational view of the conventional cutting element of FIG. 1 with a reinforcing shroud mounted thereon.
Figure 3:
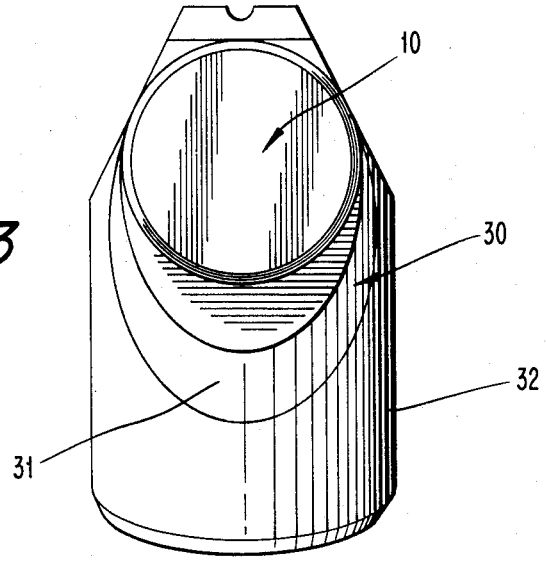
FIG. 3 (PRIOR ART)
FIG. 3 is a front elevational view of the cutting element of FIG. 2 as viewed in a direction perpendicular to a supporting surface 20 of the cutting element.

During a cutting operation, cutting forces will be transmitted to the shoulder by the cutting disc 10A. The shoulder will reinforce the cutting disc and, in so doing, will transmit forces to the support surface 20A of the stud. The weakest area of the surface 20A lies along the edge 42 and, thus, the potential fracture area will lie along the region 53 of that edge 42 where the forces from the shoulder are being applied. However, since the forwardmost point 52 of that region 53 is spaced rearwardly from the reawardmost point of the cutting disc and is also spaced rearwardly from the contact face 46, such point 52 can be positioned within the bore 54 as noted earlier. Therefore, the entire periphery of the stud will be reinforced by the bore wall at the elevations of the entire region 53, including the forwardmost point 52 thereof, so as to effectively resist the formation of a fracture line. This is in contrast to the prior art arrangement of FIGS. 2 and 3 in which the region along which the shroud 30 intersects the edge of the surface 20 has a forwardmost point 36 situated substantially forwardly of the rearwardmost point of the cutting disc, and out of the bore of the drill bit.

Even though the cutting member has been disclosed in the shape of a circular disc, that cutting member can be of any suitable shape, including semi-circular for example.

Although the present invention has been described in connection with preferred embodiments thereof, it will be appreciated by those skilled in the art that additions, modifications, substitutions and deletions not specifically described, may be made without departing from the spirit and scope of the invention as defined in the appended claims.

What I claim is:

1. A cutting element positionable within a drill bit body, said cutting element comprising:

a stud having a cylindrical side surface and an inclined supporting surface disposed at a forward end of said stud, said supporting surface oriented at an acute angle relative to a longitudinal axis of said stud and intersecting said side surface to form an edge, a cutting member bonded to said supporting surface and comprising a substrate having thereon a cutting surface of polycrystalline diamond, said cutting member including a peripheral surface, and a reinforcing shoulder projecting from said supporting surface adjacent a rear portion of said peripheral surface of said cutting member, said shoulder including a contact face engaging said rear portion, and a side surface intersecting said edge along a region of said edge, a forwardmost point of said region being spaced rearwardly from a rearwardmost point of said cutting member and also being spaced rearwardly from said contact face, said side surface of said shoulder being substantially cylindrical and contiguous with said side surface of said stud so as to define a continuation thereof.

2. A cutting element according to claim 1, wherein said cutting member is of circular configuration.

3. A cutting element according to claim 1, wherein said stud is formed of carbide.

4. A cutting element according to claim 3, wherein said substrate is formed of carbide.

5. A cutting element according to claim 1, wherein said shoulder and said stud are of integral one-piece construction.

6. A drill bit comprising:

a bit body having a plurality of bores provided therein, each bore including a cylindrical wall, and a plurality of cutting elements positioned in respective ones of said bores, each cutting element comprising:

a stud having a cylindrical side surface and an inclined supporting surface disposed at a forward end of said stud, said supporting surface oriented at an acute angle relative to a longitudinal axis of said stud and intersecting said side surface to form an edge, said stud being disposed in said respective bore, a cutting member bonded to said supporting surface and comprising a substrate having thereon a cutting surface of polycrystalline diamond, said cutting member including a peripheral surface, and a reinforcing shoulder projecting from said supporting surface adjacent a rear portion of said peripheral surface of said cutting member, said shoulder including a contact face engaging said rear portion, and a side surface intersecting said edge along a region of said edge, a forwardmost point of said region being spaced rearwardly from a rearwardmost point of said cutting member and also being spaced rearwardly from said contact face, said forwardmost point being positioned within said respective bore, said side surface of said shoulder being substantially cylindrical and contiguous with said side surface of said stud so as to define a continuation thereof.

7. A drill bit according to claim 6, wherein said cutting member is of circular configuration.

8. A drill bit according to claim 6, wherein said stud is formed of carbide.

9. A drill bit according to claim 8, wherein said substrate is formed of carbide.

* * * * *